US009854913B1

(12) United States Patent
Lin

(10) Patent No.: US 9,854,913 B1
(45) Date of Patent: Jan. 2, 2018

(54) TELESCOPIC LEG UNIT FOR TABLE AND CHAIR

(71) Applicant: ANN YANG INC., Hsinchu County (TW)

(72) Inventor: Hsin-Yi Lin, Hsinchu County (TW)

(73) Assignee: ANN YANG INC., Hsinchu County (TW)

( * ) Notice: Subject to any disclaimer, the term of this patent is extended or adjusted under 35 U.S.C. 154(b) by 0 days.

(21) Appl. No.: 15/592,239

(22) Filed: May 11, 2017

(51) Int. Cl.
*F16M 11/26* (2006.01)
*A47C 3/26* (2006.01)
*A47C 3/40* (2006.01)
*A47B 9/20* (2006.01)

(52) U.S. Cl.
CPC ..... *A47C 3/26* (2013.01); *A47B 9/20* (2013.01); *A47C 3/40* (2013.01)

(58) Field of Classification Search
CPC .. A47C 3/26; A47C 3/265; A47C 3/40; F16B 7/10; F16B 7/105; F16B 7/14; F16B 7/1409; F16B 2/16; A45B 2009/007; A63C 11/221; E04G 25/04
USPC ..... 248/188.5; 403/109.2–109.3, 377, 109, 403/322.2
See application file for complete search history.

(56) References Cited

U.S. PATENT DOCUMENTS 811,712 A * 2/1906 Graefe ..... A47C 3/26 108/146
817,234 A * 4/1906 Fagerstrom ..... A47C 3/26 108/141
1,246,837 A * 11/1917 Anthony ..... A47C 3/26 248/408
2,388,056 A * 10/1945 Hendricks ..... A47B 9/00 108/147
2,542,480 A * 2/1951 Cramer ..... A47C 3/26 248/408
2,719,688 A * 10/1955 Seifert ..... A47F 7/06 248/188.5
2,780,277 A * 2/1957 Ries ..... A47C 1/08 188/5
3,560,033 A * 2/1971 Barkus ..... A47C 3/26 248/412
3,722,903 A * 3/1973 Jones ..... A63C 11/221 16/429
4,480,497 A * 11/1984 Locher ..... F16B 7/14 188/67

(Continued)

*Primary Examiner* — Christopher Garft
(74) *Attorney, Agent, or Firm* — Lin & Associates Intellectual Property, Inc.

(57) ABSTRACT

A leg unit an outer tube with a fixing rod having several rod sections, each has two interconnected curved and straight sides, two curved sides along an axis defining a fixing channel; an inner tube inserted into the outer tube; and a carrier seat fixed to the inner tube, and a limiting seat seated within the carrier set such that the carrier and limiting seats can rotate together, the carrier seat has an axial hole, two stems extending transversely through the hole to restrict one rod section therebetween, the limit seat has a slide hole complementing with and permitting extension of the fixing rod; the inner tube is rotatable relative to the outer tube between an unlocked position, where movement between the inner and outer tubes is permitted and a locked position, where the stems are confined within the channels, thereby preventing movement between the inner and outer tubes.

8 Claims, 11 Drawing Sheets

(56) References Cited

U.S. PATENT DOCUMENTS

| | | | | | |
|---|---|---|---|---|---|
| 5,826,847 | A * | 10/1998 | Warner | F16B 7/1463 | 248/200.1 |
| 5,881,980 | A * | 3/1999 | Knudson | A47B 9/00 | 108/147.19 |
| 6,698,698 | B1 * | 3/2004 | Hsieh | F16B 7/105 | 248/125.8 |
| 6,957,865 | B1 * | 10/2005 | Adams | A47B 91/024 | 297/344.12 |
| 7,198,236 | B2 * | 4/2007 | Warner | F16B 7/149 | 248/125.8 |
| 7,434,495 | B2 * | 10/2008 | Lin | B25B 13/461 | 16/429 |
| 7,497,149 | B2 * | 3/2009 | Lin | B25B 13/461 | 403/109.3 |
| 7,878,094 | B2 * | 2/2011 | Lin | B25G 1/043 | 403/109.3 |
| 8,220,101 | B2 * | 7/2012 | Chen | A47L 13/20 | 15/119.1 |
| 9,629,452 | B1 * | 4/2017 | Chen | A47B 9/20 | |
| 2006/0202098 | A1 * | 9/2006 | Hsieh | F16B 7/105 | 248/410 |
| 2008/0121150 | A1 * | 5/2008 | Picchio | A47B 9/04 | 108/147.19 |
| 2011/0041739 | A1 * | 2/2011 | Verweij | A47B 9/04 | 108/147.19 |
| 2015/0059816 | A1 * | 3/2015 | Kim | A45B 9/00 | 135/75 |
| 2015/0320213 | A1 * | 11/2015 | Sorrell | A47B 13/083 | 108/27 |
| 2016/0069118 | A1 * | 3/2016 | Artin | E05C 17/30 | 16/85 |
| 2017/0097036 | A1 * | 4/2017 | Miehe | F16C 3/03 | |

* cited by examiner

TELESCOPIC LEG UNIT FOR TABLE AND CHAIR

BACKGROUND OF THE INVENTION

1. Field of the Invention

The present invention relates to a leg unit, more particularly to a telescopic leg unit for table and chair, in which two telescopically connected tubes are rotatable relative to each other between an unlock position and a locked position.

2. The Prior Arts

The advance of artistic technology, a majority of customers take into account the convenient usage, lasting period and safety measurements of a product in addition to the quality and price of the product Regarding a table or chair, the length of the table leg, is generally fixed such that the height of the table cannot be altered in order to suit the user of variation height. Especially for a study table, which user grows up from a childhood to an adult, his study table becomes useless due to unable to adjust the height of table legs.

To eliminate the problems caused due to lacking height adjustment of table legs, a telescopic leg unit has be proposed, which mainly includes an outer tube and an inner tube telescopically inserted into or retracted from the outer tube, after which manually operated fixing means are used to fix the height or the length of the leg unit. The manually fixing means include the following:

1. Screw threads method: the outer and inner tubes have inner and outer screw threads at the connection parts thereof. However, a table has at least three leg units and it is somewhat difficult and time-consuming to adjust three of the leg units into the same height by means of user hands.
2. Pin insert type: a fixing pin is inserted through the fixing holes in the outer and inner tubes so as to adjust the desired height of the leg unit. The problems are that it is laborious to align and insert the fixing pin into the fixing holes of the inner and outer tubes after removing the two tubes relative to each other. Moreover, the fixing pin when protrudes outwardly and radially from the inner and outer tube may scratch or injures the user accidentally.
3. Ratchet teeth fixing method: after axial adjustment of the telescopically connected outer and inner tubes, one is rotated in a single direction relative to the other so as to fix the two tubes together. In case the adjusted length of the two tubes does not fit the desired length, the inner tube needs be axially pulled out from the outer tube and re-adjust of the length needs be conducted, which results in waste of manual labor.

SUMMARY OF THE INVENTION

A primary objective of the present invention is to provide a telescopic leg unit for a table, in which manual labor is required to rotate one tube relative to the other in order to dispose the telescopic leg unit between an unlocked position and a locked position, wherein only 90 degree rotation of one tube relative to the other can dispose the leg unit in the unlocked position.

Another objective of the present invention is to provide a telescopic leg unit for a table, in which a locking mechanism is installed and hidden within the telescopically connected tubes so as to provide an aesthetic appearance and the locking mechanism is easy to operate, thereby providing little malfunction.

In order to achieve the aforesaid the objective, a telescopic leg unit for table and chair of the present invention includes: an outer tube having an axially extending fixing rod, which is constituted by a plurality of integrally formed rod sections, each rod section having two opposed curved sides and two opposed straight sides interconnecting the curved sides, an adjacent pair of the curved sides along an axis of the fixing rod defining a fixing channel therebetween; an inner tube inserted movably and axially into the outer tube; and a locking mechanism including a carrier seat fixed to an upper end of the inner tube, defining a seating chamber and a limiting seat seated within the seating chamber in such a manner that the carrier seat and the limiting seat can rotate together and simultaneously only in a preset angle, the carrier seat having an axial hole permitting extension of the fixing rod, two parallel limit stems extending transversely through the axial hole to restrict one rod section of the fixing rod therebetween, the limit seat being formed with a central slide hole with a cross section complementing with and permitting extension of the fixing rod through the central slide hole; wherein, the inner tube is rotatable relative to the outer tube between an unlocked position, where the parallel limit stems of the carrier seat are placed on the straight sides of the fixing rod, thereby permitting axial movement of the inner tube relative to the outer tube, and a locked position, where the parallel limit stems of the carrier seat are placed within the fixing channels of the fixing rod, thereby preventing axial movement between the inner tube and the outer tube.

In order to sustain and enhance the locked position of the leg unit of the present invention, the carrier seat has an upper set of the parallel limit stems and a lower set of the parallel limit stems located below the upper set, wherein the upper and lower sets of the parallel limit stems define an axial length equivalent to an axial length defined between an adjacent pair of the fixing channels along an axis of the fixing rod.

The leg unit of the present invention further includes at least one set of spring-loaded biasing unit installed within a reception slot of the carrier seat, wherein the reception slot is located between the parallel limit stems and has an opening oriented perpendicularly toward the axial hole of the carrier seat. The set of spring-loaded biasing unit includes a metal ball, a spring disposed in the reception slot for biasing the metal ball abutting against the fixing rod. After the length adjustment between the outer and inner tubes, the metal ball is located within the fixing channel of the fixing rod such that the leg unit can be disposed in either the unlocked position or the locked position.

In the leg unit of the present invention, the limiting seat and the carrier seat are rotatable relative to each other within a preset angle, which is carried out in two types. Firstly, the limiting seat is further formed with a curved guide groove off set from the central slide hole. The carrier seat further has a position limiting pin projecting upward from a bottom surface of the seating chamber to extend slidably through the curved guide groove in the limiting seat such that sliding movement of the position limiting pin within the curved guide groove permits 90° rotation between the limiting seat and the carrier seat. Secondly, the carrier seat further has a seat-reception chamber that is located opposite to the seating chamber and that is confined by an inner peripheral wall formed with at least one engagement recess. The limiting seat further has a lower projection that extends downward from a periphery confining the central slide hole and that is formed with an engaging tongue such that sliding movement of the engaging tongue within the engagement recess permits 90° (90 degree) rotation between the limiting seat and the carrier seat.

In order to sustain and enhance the locked and unlocked positions of the inner tube relative to the outer tube, the limiting seat further has an outer peripheral portion formed with at least one protrusion extending radially and outwardly therefrom and a buffering aperture located adjacent to the protrusion to permit radially and inwardly retraction of the protrusion. The seating chamber of the carrier seat is confined by a vertical wall formed with two engagement grooves of different dimensions, into one of which the protrusion extends, thereby maintaining the carrier seat and the limiting seat relative to each other.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
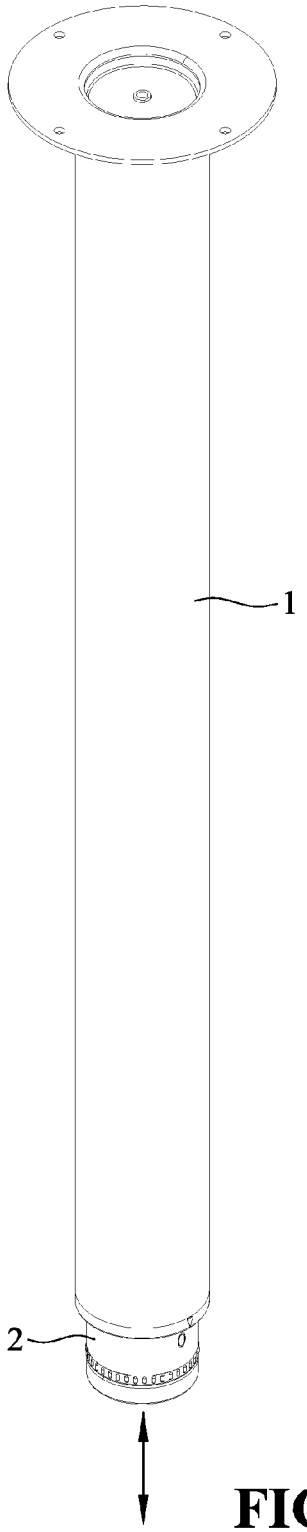
FIG. 1 is a perspective view of a telescopic leg unit for table and chair according to the present invention.
Figure 2:
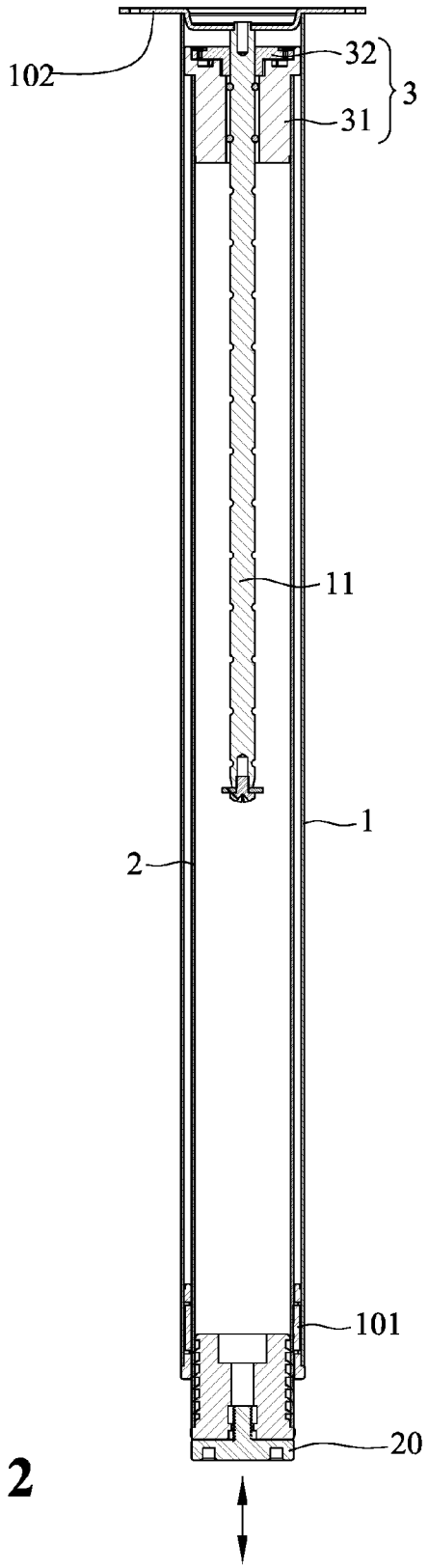
FIG. 2 is a cross sectional view of the telescopic leg unit of the present invention shown in FIG. 1.
Figure 3:
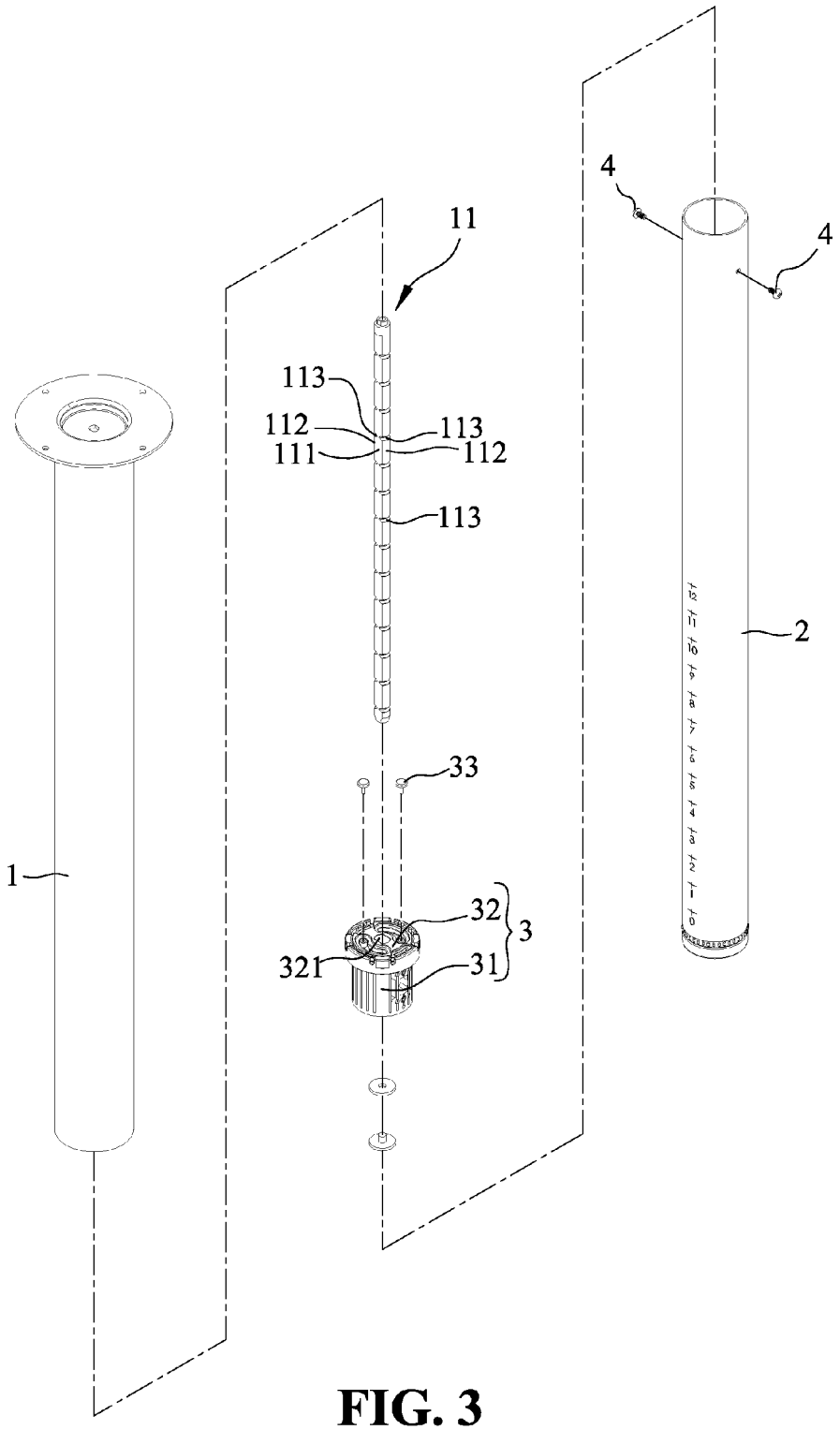
FIG. 3 is a perspective and exploded view of the telescopic leg unit for table and chair according to the present invention.
Figure 10:
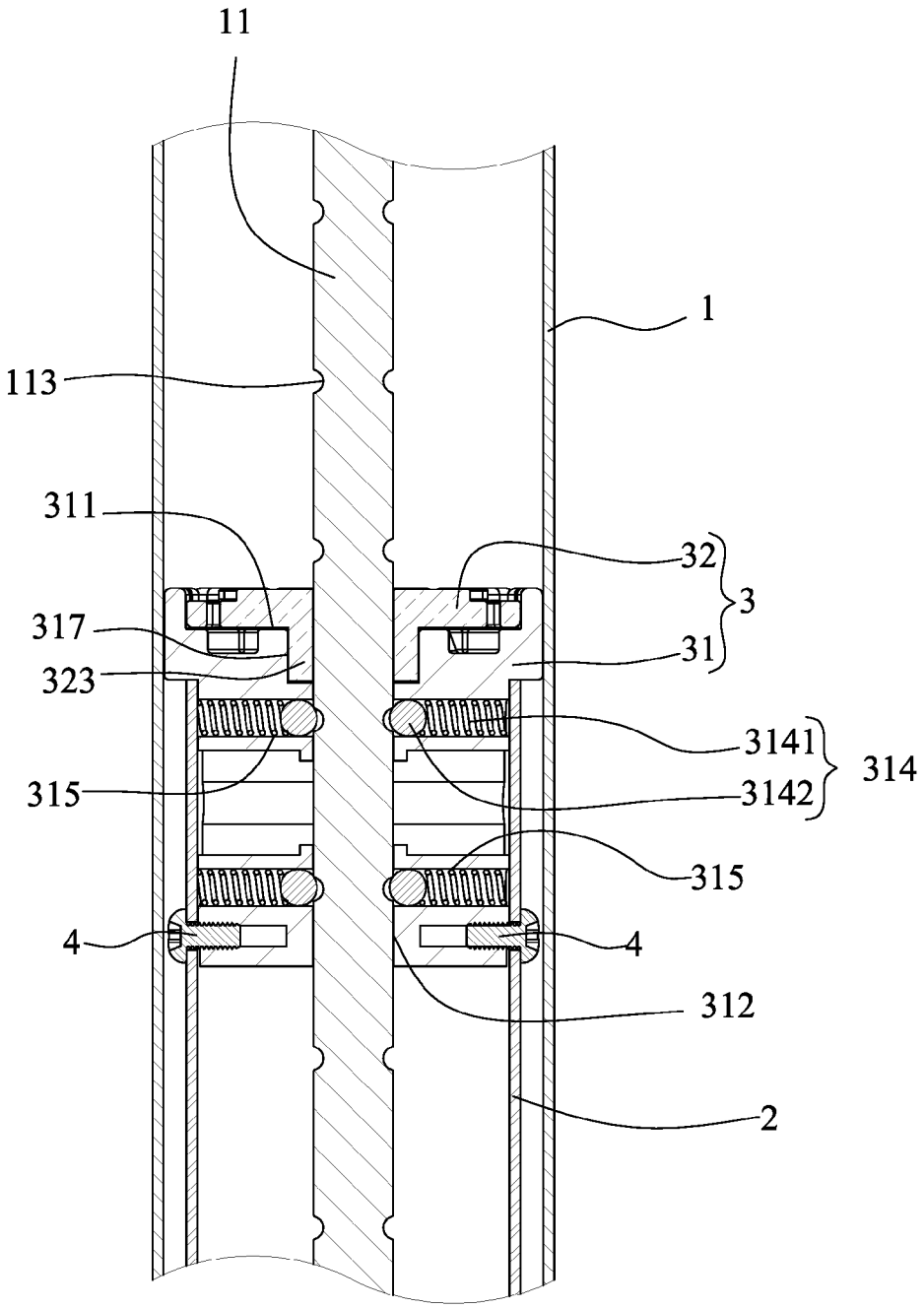
FIG. 10 is a cross sectional view illustrating how a spring-loaded biasing unit is installed within the telescopic leg unit of the present invention.

Referring to FIGS. 1 to 3, wherein FIG. 1 is a perspective view of a telescopic leg unit for table and chair according to the present invention; FIG. 2 is a cross sectional view of the telescopic leg unit of the present invention shown in FIG. 1; and FIG. 3 is a perspective and exploded view of the telescopic leg unit for table and chair according to the present invention. As shown, a telescopic leg unit for table and chair of the present invention includes an outer tube 1, an inner tube 2 and a locking mechanism 3. The upper end of the outer tube 1 is adapted to be fixed to a bottom surface of a table while the inner tube 2 is inserted movably and axially into the outer tube 1 and has a bottom end to be disposed on the flooring. The locking mechanism 3 is fixed to the top end of the inner tube 2. In this embodiment, a pair of fixing screws 4 (see FIG. 10) is used for fixing the locking mechanism 3 at the top end of the inner tube 2. After assembly of the leg unit of the present invention, the inner tube 2 is rotatable relative to the outer tube 1 between an unlocked position by virtue of the locking mechanism 3, where an axial movement of the inner tube 2 relative to the outer tube 1 is permitted and a locked position by virtue of the locking mechanism 3, where an axial movement between the inner tube 2 and the outer tube 1 is prevented. A detailed description thereof is given in the following paragraphs.

Figure 4:
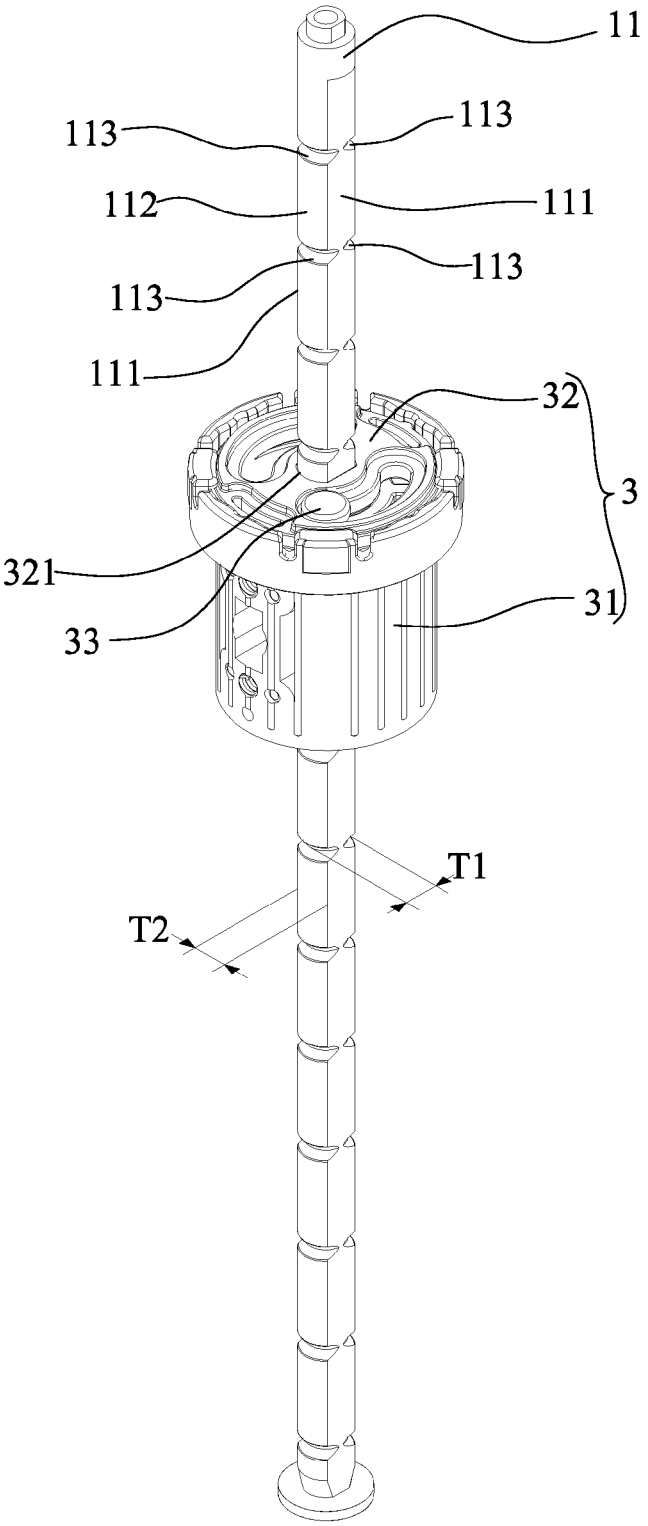
FIG. 4 illustrates how a locking mechanism is mounted on a fixing rod in the telescopic leg unit according to the present invention.
Figure 8:
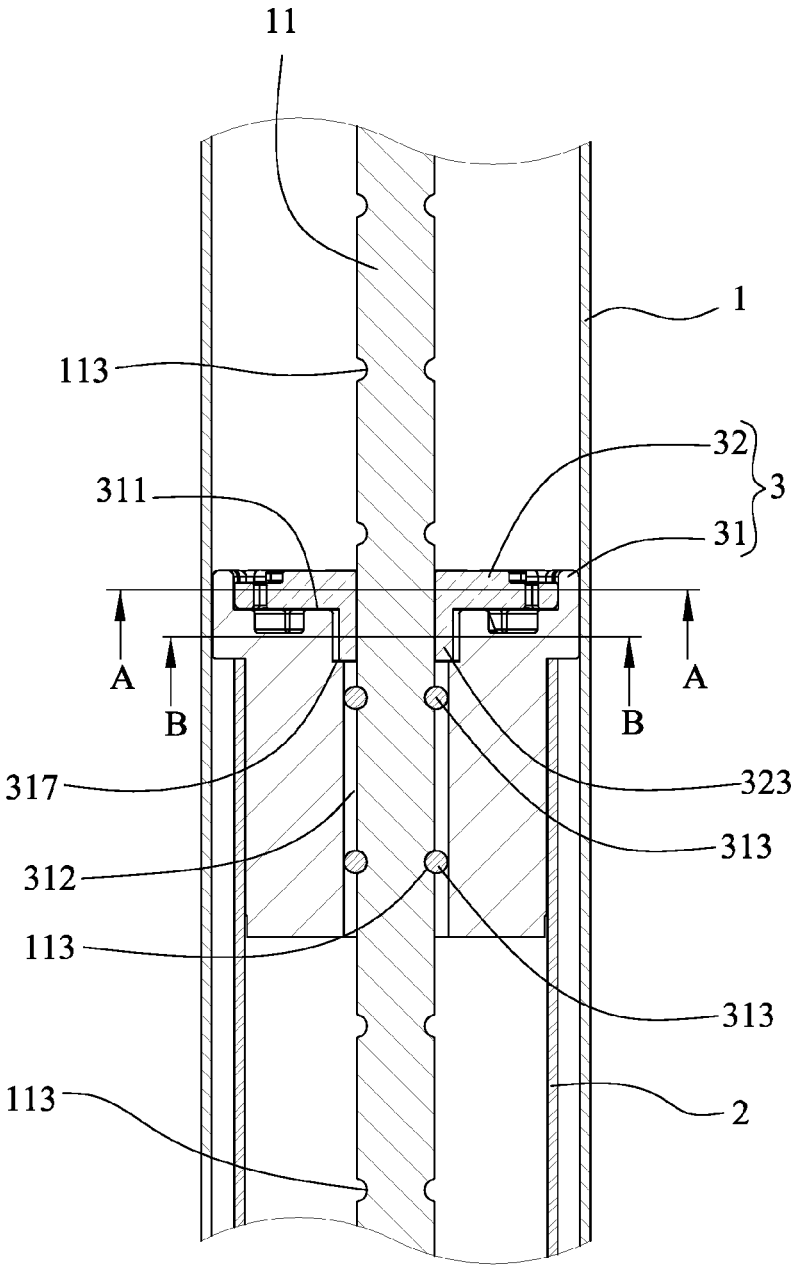
FIG. 8 illustrates a cross sectional view of the telescopic leg unit of the present invention in the locked position.
Figure 11A:
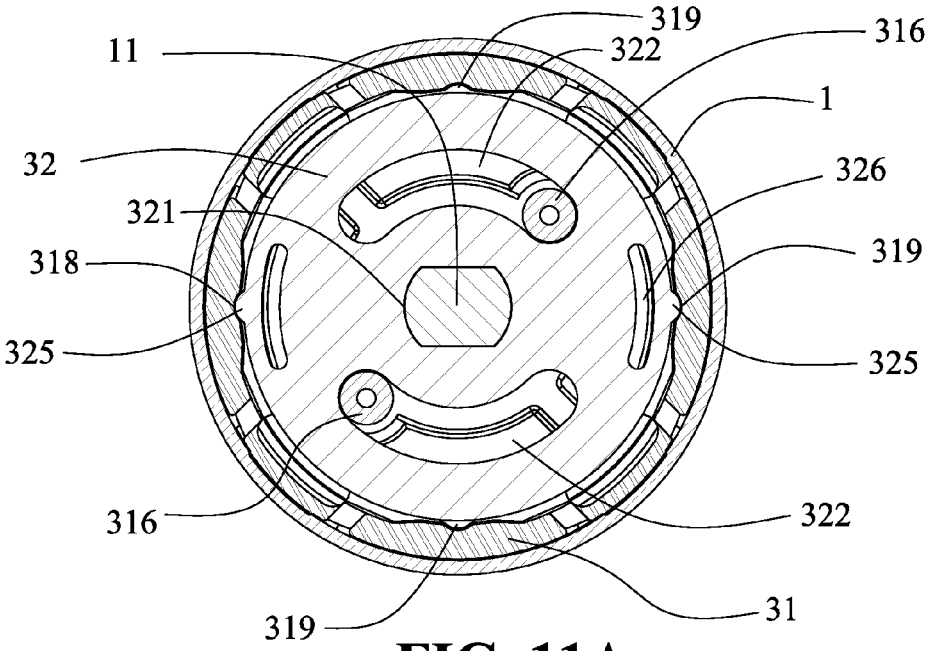
FIG. 11A is a cross section view of the telescopic leg unit of the present invention taken along lines A-A in FIG. 8.

The outer and inner tubes 1, 2 are hollow cylindrical tubes made from metals. The inner tube 2 is movably and axially inserted into the outer tube 1 and a bearing unit can be disposed between the connecting parts of the outer and inner tubes 1, 2 to facilitate relative rotation or axial movement therebetween. In this embodiment, a bearing unit 101 is installed at the lower connecting part of the outer tube 1 (see FIG. 1) while an outer periphery of the locking mechanism 3 serves the function of a bearing unit to facilitate relative rotation or axial movement between the outer and inner tubes 1, 2. A top plate 102 is fixed on the upper end of the outer tube 1 for fixing to the bottom surface of a table. Of course, the top plate 102 may have other configuration depending on the size and shape of the table. A leg pad 20 can be fixed to the bottom end of the inner tube 2 to provide anti-slippery function with respect to the support flooring The outer tube 1 has an axially extending fixing rod 11, as best shown in FIGS. 2, 3 and 4, the fixing rod 11 in fact is cylindrical and is machined in such a manner to possess two parallel straight sides and two curved sides (see FIG. 11A). In other words, the fixing rod 11 is constituted by a plurality of integrally formed rod sections, each rod section has two opposed curved sides 112 and two opposed straight sides 111 interconnecting the curved sides 112, an adjacent pair of the curved sides 112 along an axis of the fixing rod 11 defines a fixing channel 113 therebetween (see FIG. 8). To be more specific, the straight sides 111 of each rod section in the fixing rod 11 define the shortest distance that is smaller than or equivalent to the shortest diameter defined between the two fixing channels 113 of the fixing rod 11. Preferably, as best shown in FIG. 4, the shortest distance $T_2$ between the straight sides 111 of each rod section is generally equivalent but smaller than the shortest diameter $T_1$ defined between the two fixing channels 113 of the fixing rod 11.

Figure 5:
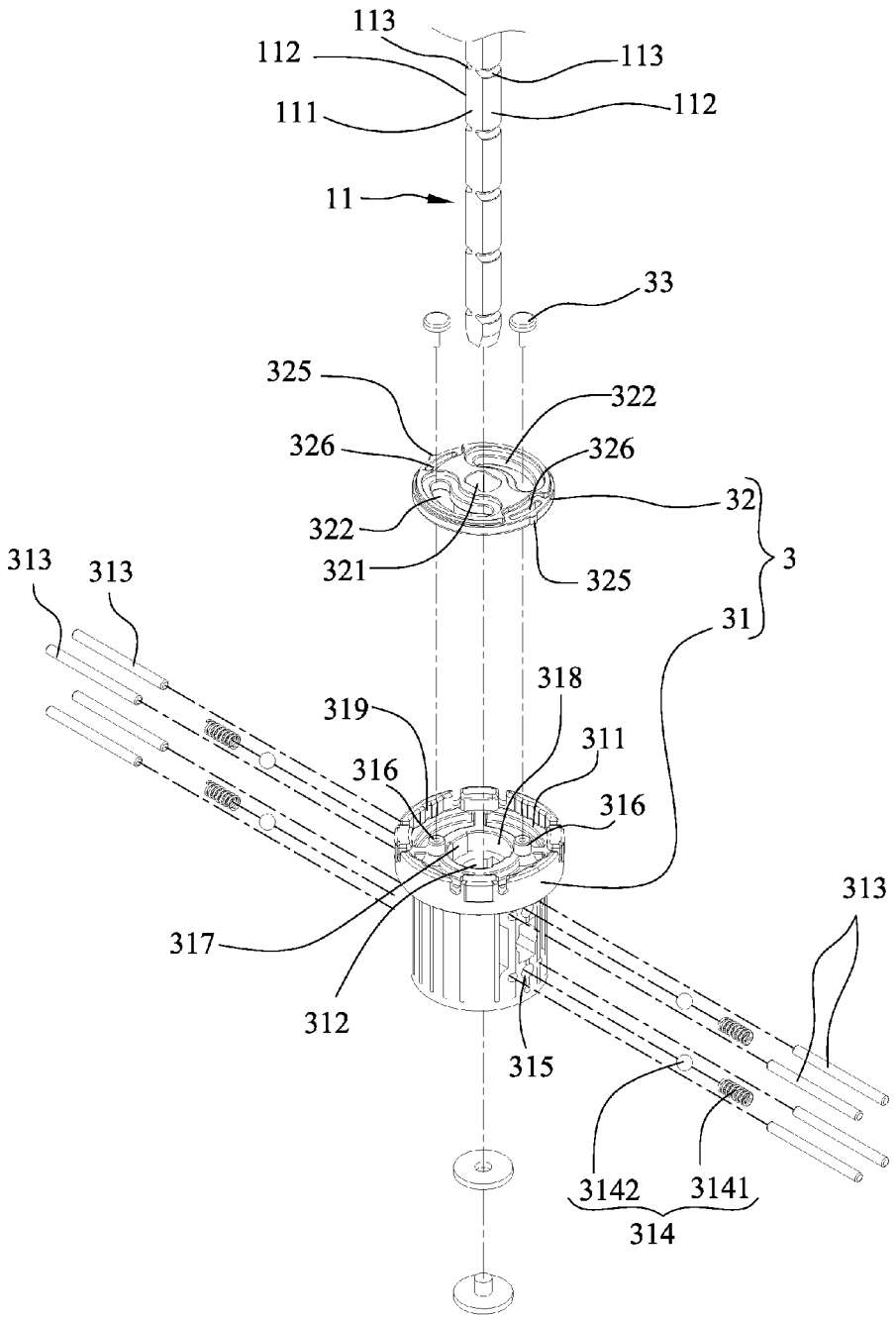
FIG. 5 illustrates an exploded view of the locking mechanism shown together with the fixing rod in the telescopic leg unit according to the present invention.
Figure 9:
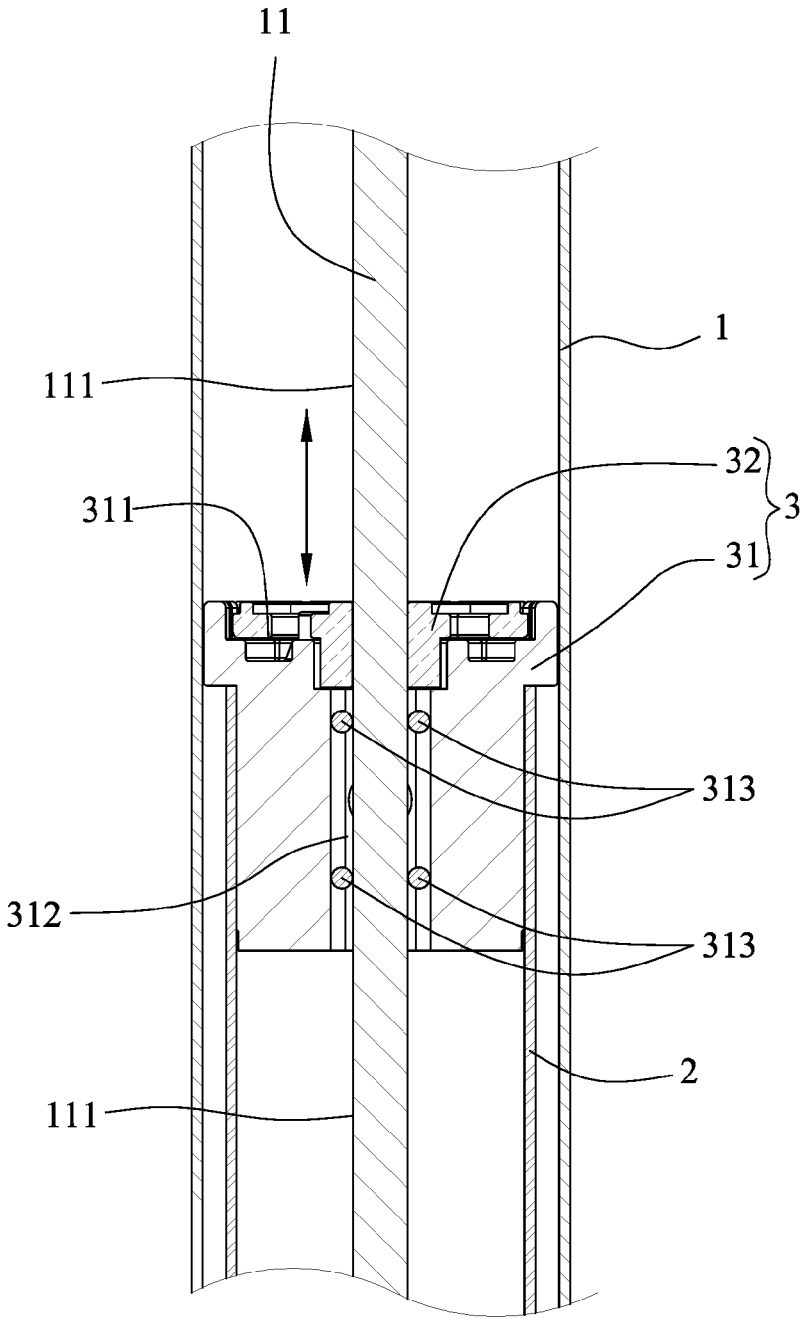
FIG. 9 illustrates a cross sectional view of the telescopic leg unit of the present invention in the unlocked position.

Referring to FIG. 5, the locking mechanism 3 includes a carrier seat 31 fixed to the upper end of the inner tube 2, defining a seating chamber 311 and a limiting seat 32 seated within the seating chamber 311 in such a manner that the carrier seat 31 and the limiting seat 32 can rotate together and simultaneously only in a preset angle. The carrier seat 31 has an axial hole 312 (see FIGS. 5 and 9) permitting extension of the fixing rod 11 therethrough, two parallel limit stems 313 extending transversely through the axial hole 312 to restrict one rod section of the fixing rod 11 therebetween. Preferably, the two parallel limit stems 313 define the shortest distance that is greater than or equivalent to the shortest diameter defined between the two fixing channels 113 of the fixing rod 11 and that is smaller than the greatest distance defined between the two fixing channels 113 of the fixing rod 11 (the greatest diameter between the opposed curved sides 112 of each rod section of the fixing rod 11). Note that the configuration of the limit stems 313 matches with the fixing channels 113 of the fixing rod 11. The limit seat 32 is formed with a central slide hole 321 with a cross section complementing with and permitting extension of the fixing rod 11 through the central slide hole 321 such that the limit seat 32 is slidable axially along the fixing rod 11 and rotation of the limit seat 32 results in rotation of the fixing rod 11 simultaneously.

Figure 6:
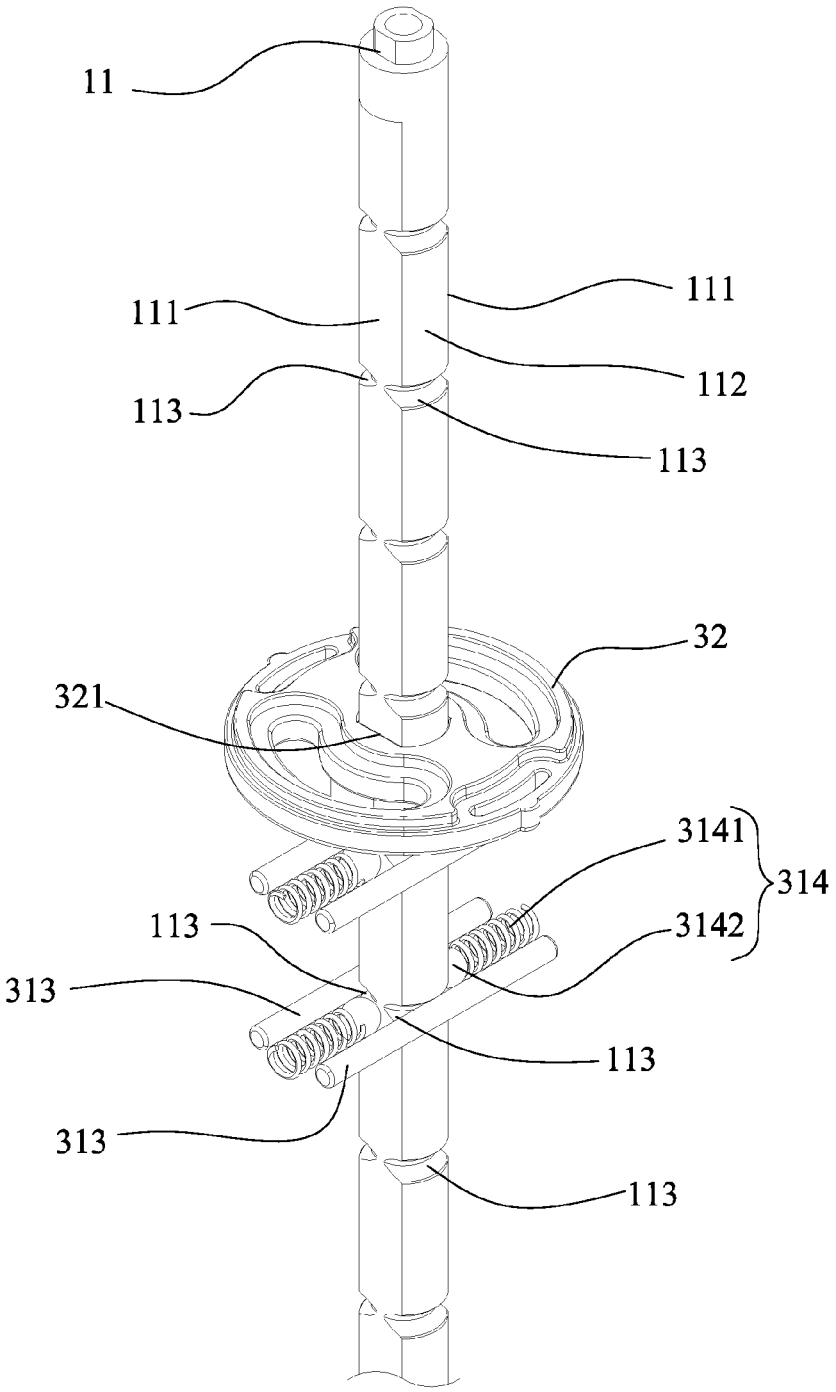
FIG. 6 illustrates a simplified configuration of the telescopic leg unit of the present invention in a locked position.
Figure 7:
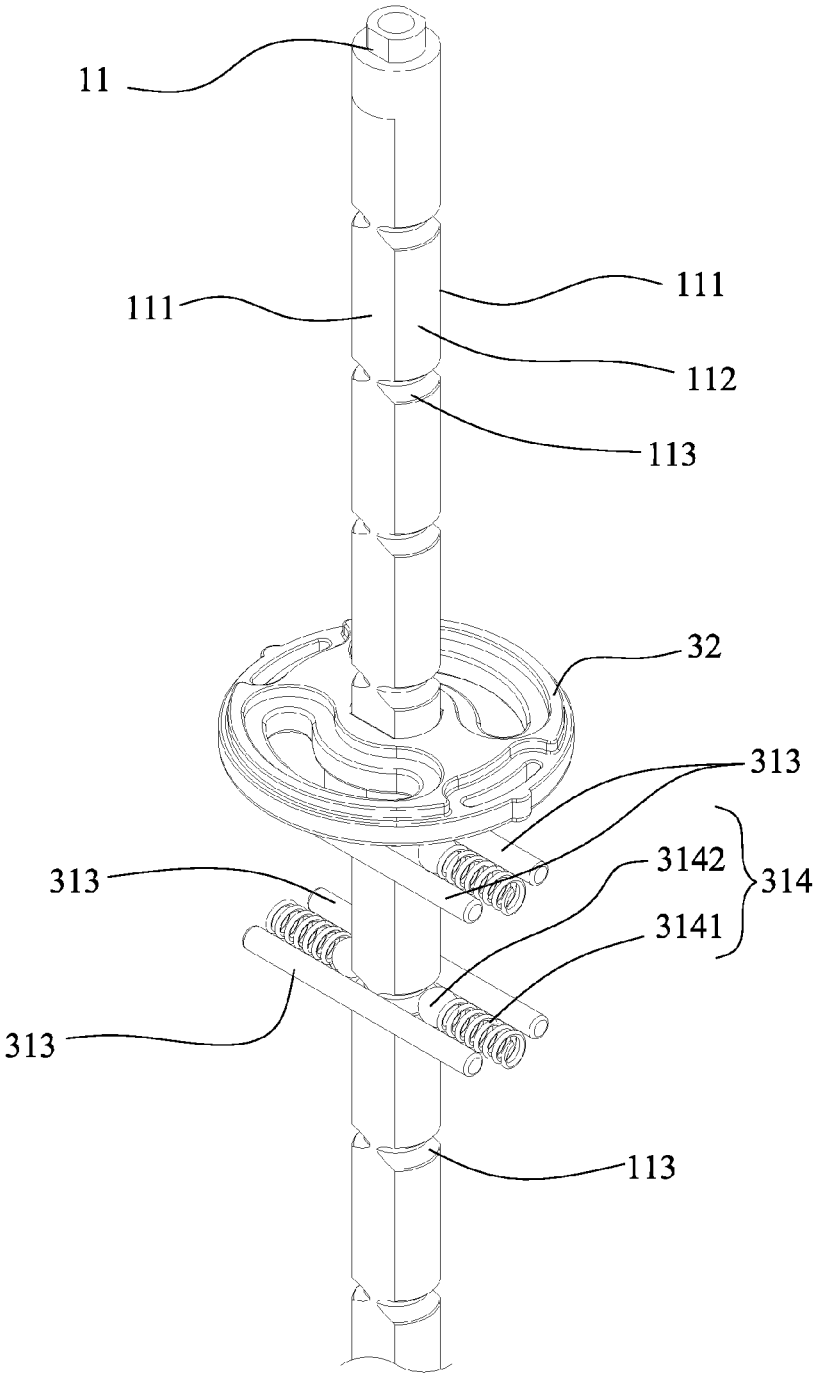
FIG. 7 illustrates a simplified configuration of the telescopic leg unit of the present invention in an unlocked position.

An important aspect to note is that the fixing rod 11 is stationary relative to the outer tube 1, but rotation of the inner tube 2 relative to the outer tube 1 causes simultaneous rotation of the carrier seat 31 and the inner tube 2 relative to the outer tube 1 between an unlocked position (see FIGS. 7 and 9), where the inner tube 2 is rotated 90° relative to the outer tube 1 such that the parallel limit stems 313 of the carrier seat 31 are placed on the straight sides 111 of the fixing rod 11 and permitting movement of the limit stems 313 on the straight sides 11, thereby permitting axial movement of the inner tube 2 relative to the outer tube 1 and consequently adjusting the length of the leg unit of the present invention, and a locked position (see FIGS. 6 and 8), where the parallel limit stems 313 of the carrier seat 31 are placed and thus confined within the fixing channels 113 of the fixing rod 11, thereby preventing axial movement between the inner tube 2 and the outer tube 1. In other words, the leg unit of the present invention provides a fixed length of the table.

In this embodiment, the carrier seat 31 has an upper set of the parallel limit stems 313 and a lower set of the parallel limit stems 313 located below the upper set, wherein the upper and lower sets of the parallel limit stems 313 define an axial length equivalent to an axial length defined between an adjacent pair of the fixing channels 113 along an axis of the fixing rod 11.

In order to sustain and enhance maintaining of the inner tube 2 relative to the outer tube 1 after each adjustment therebetween, four spring-loaded biasing units 314 are provided, each spring-loaded biasing unit 314 is installed within a reception slot 315 of the carrier seat 31, wherein the reception slot 315 is located between the parallel limit stems 313 and has an opening oriented perpendicularly toward the axial hole 312 of the carrier seat 31, the set of spring-loaded biasing unit 314 includes a metal ball 3142, a spring 3141 disposed in the reception slot 315 for biasing the metal ball 3142 abutting against the fixing rod 11.

Note that once the limiting seat 32 is seated within the seating chamber 311 of the carrier seat 1, the carrier seat 31 and the limiting seat 32 can rotate relative to each other within a preset angle. To be more specific, two opposite ends of the preset angle respectively defined the unlocked position and the locked position, which is carried out in two types. Firstly, the limiting seat 32 is further formed with two curved guide grooves 322 off set from the central slide hole 321. The carrier seat 31 further has two position limiting pins 316 (see FIGS. 5 and 11A) projecting upward from a bottom surface of the seating chamber 311 to extend slidably through the respective curved guide grooves 322 in the limiting seat 32 such that sliding movement of the position limiting pins 316 within the curved guide grooves 322 permits 90° rotation between the limiting seat and the carrier seat 31.

Figure 11B:
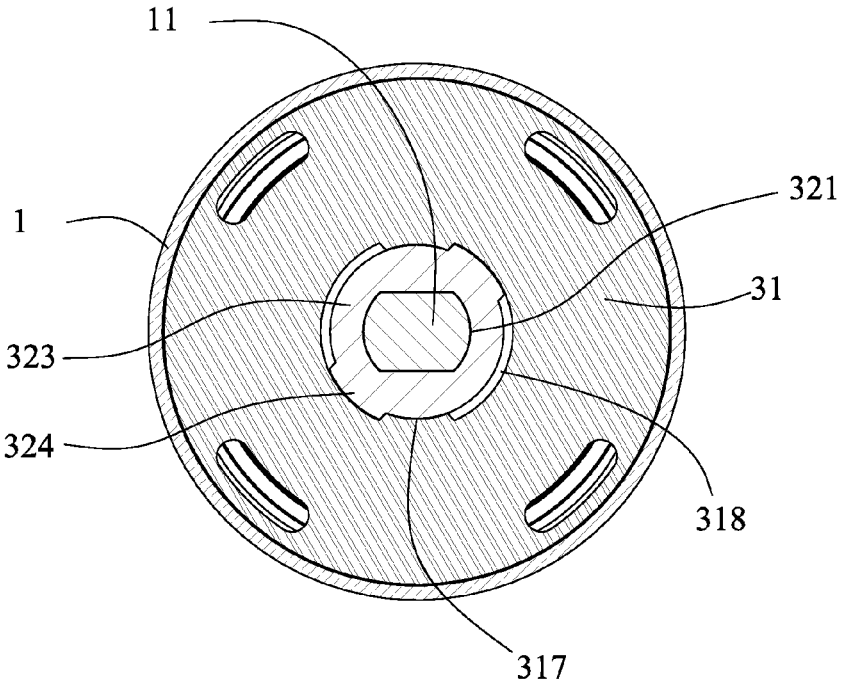
FIG. 11B is a cross section view of the telescopic leg unit of the present invention taken along lines B-B in FIG. 8.

Secondly, the carrier seat 31 further has a seat-reception chamber 317 (see FIGS. 5, 8 and 11B) that is located opposite to the seating chamber 311, that is confined by an inner peripheral wall formed with at least one engagement recess 318. The limiting seat 32 further has a lower projection 323 that extends downward from a periphery confining the central slide hole 321 and that is formed with an engaging tongue 324 such that sliding movement of the engaging tongue 324 within the engagement recess 318 permits 90° rotation between the limiting seat 32 and the carrier seat 31.

in order to sustain and enhance maintaining of the inner tube 2 relative to the outer tube 1 during the unlocked and locked positions, the limiting seat 32 further has an outer peripheral portion fonned with two protrusion 325 extending radially and outwardly therefrom and spaced apart each other by 180° and a buffering aperture 326 located adjacent to the protrusion 325 to permit radially and inwardly retraction of the protrusions 325. The seating chamber 311 of the carrier seat 31 is confined by a vertical wail formed with two pairs of engagement grooves 319 of different dimensions, into one pair of which the protrusions 325 extends, thereby maintaining the carrier seat 31 and the limiting seat 32 relative to each other.

Once the limiting seat 32 is seated with the seating chamber 311 of the carrier seat 31, a pair of fixing screws 33 fixed respectively to the position limiting pins 316, wherein each of the fixing screws 33 has a cross section greater than a cross section of the curved guide grooves the, thereby preventing untimely disengagement of the carrier seat 31 and the limiting seat 32.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A telescopic leg unit for table and chair, comprising:

an outer tube having an axially extending fixing rod, which is constituted by a plurality of integrally formed rod sections, each rod section having two opposed curved sides and two opposed straight sides interconnecting said curved sides, an adjacent pair of said curved sides along an axis of said fixing rod defining a fixing channel therebetween;

an inner tube inserted movably and axially into said outer tube; and a locking mechanism including a carrier seat fixed to an upper end of said inner tube, defining a seating chamber and a limiting seat seated within said seating chamber in such a manner that said carrier seat and said limiting seat can rotate together and simultaneously only in a preset angle, said carrier seat having an axial hole permitting extension of said fixing rod, two parallel limit stems extending transversely through said axial hole to restrict one rod section of said fixing rod therebetween, said limit seat being formed with a central slide hole with a cross section complementing with and permitting extension of said fixing rod through said central slide hole;

wherein, said inner tube is rotatable relative to said outer tube between an unlocked position, where said parallel limit stems of said carrier seat are placed on said straight sides of said fixing rod, thereby permitting axial movement of said inner tube relative to said outer tube, and a locked position, where said parallel limit stems of said carrier seat are placed within said fixing channels of said fixing rod, thereby preventing axial movement between said inner tube and said outer tube.

2. The telescopic leg unit according to claim 1, wherein said straight sides of each rod section in said fixing rod define the shortest distance that is smaller than or equivalent to the shortest diameter defined between said two fixing channels of said fixing rod, said two parallel limit stems defining the shortest distance that is greater than or equivalent to the shortest diameter defined between said two fixing channels of said fixing rod and that is smaller than the greatest distance defined between said two fixing channels of said fixing rod.

3. The telescopic leg unit according to claim 1, wherein said carrier seat has an upper set of said parallel limit stems and a lower set of said parallel limit stems located below said upper set, wherein said upper and lower sets of said parallel limit stems define an axial length equivalent to an axial length defined between an adjacent pair of said fixing channels along an axis of said fixing rod.

4. The telescopic leg unit according to claim 1, further comprising at least one set of spring-loaded biasing unit installed within a reception slot of said carrier seat, wherein said reception slot is located between said parallel limit stems and having an opening oriented perpendicularly toward said axial hole of said carrier seat, said set of spring-loaded biasing unit including a metal ball, a spring disposed in said reception slot for biasing said metal ball abutting against said fixing rod.

5. The telescopic leg unit according to claim 1, wherein said limiting seat is further formed with a curved guide groove off set from said central slide hole, said carrier seat further has a position limiting pin projecting upward from a bottom surface of said seating chamber to extend slidably through said curved guide groove in said limiting seat such that sliding movement of said position limiting pin within said curved guide groove permits 90° rotation between said limiting seat and said carrier seat.

6. The telescopic leg unit according to claim 1, wherein said carrier seat further has a seat-reception chamber that is located opposite to said seating chamber, that is confined by an inner peripheral wall formed with at least one engagement recess, said limiting seat further has a lower projection that extends downward from a periphery confining said central slide hole and that is formed with an engaging tongue such that sliding movement of said engaging tongue within said engagement recess permits 90° rotation between said limiting seat and said carrier seat.

7. The telescopic leg unit according to claim 1, wherein said limiting seat further has an outer peripheral portion formed with at least one protrusion extending radially and outwardly therefrom and a buffering aperture located adjacent to said protrusion to permit radially and inwardly retraction of said protrusion, said seating chamber of said carrier seat is confined by a vertical wall formed with two engagement grooves of different dimensions, into one of which said protrusion extends, thereby maintaining said carrier seat and said limiting seat relative to each other.

8. The telescopic leg unit according to claim 5, further comprising a fixing screw fixed to said position limiting pin, wherein said fixing screw has a cross section greater than a cross section of said curved guide groove, thereby preventing untimely disengagement of said carrier seat and said limiting seat.

* * * * *